United States Patent [19]

Preuss et al.

[11] 3,931,791

[45] Jan. 13, 1976

[54] MECHANISM FOR APPLYING LACQUERS AND THE LIKE ON A PRINTING PRESS

[75] Inventors: Friedrich Preuss, Sprendlingen; Kurt Difflipp, Dietzenbach, both of Germany

[73] Assignee: Roland Offsetmaschinenfabrik Faber & Schleicher AG, Germany

[22] Filed: Sept. 5, 1974

[21] Appl. No.: 503,475

[30] Foreign Application Priority Data

Sept. 7, 1973 Germany ..... 2345183

[52] U.S. Cl. ..... 118/236; 118/249; 118/262

[51] Int. Cl.[2] ..... B05C 1/02

[58] Field of Search ..... 118/262, 46, 236, 239, 118/231, 249, 250; 101/350

[56] References Cited

UNITED STATES PATENTS

| | | | |
|---|---|---|---|
| 510,630 | 12/1893 | Dean | 118/231 |
| 2,278,563 | 4/1942 | Recht | 118/262 X |
| 2,724,362 | 11/1955 | Burke et al. | 118/60 X |
| 2,754,753 | 7/1956 | Chase | 101/350 |

*Primary Examiner*—John P. McIntosh
*Attorney, Agent, or Firm*—Wolfe, Hubbard, Leydig, Voit & Osann, Ltd.

[57] ABSTRACT

Sheet coating means for a printing press including a back-up cylinder and form cylinder having an associated fountain, the fountain having a fountain roller rotating adjacent the form cylinder. Also rotating adjacent the form cylinder is a first form roller which is coupled to the fountain roller via a dosing roller. The fountain and its associated rollers are mounted upon a subframe having provision for (a) shifting the fountain roller into liquid transmitting contact with the form cylinder and (b) shifting the first form roller into liquid transmitting contact with the form cylinder thereby, selectively, to change the length of the liquid transference path from the fountain to a sheet carried by the back-up cylinder in accordance with the drying speed of the coating material. In a preferred embodiment the fountain assembly includes a second form roller rotating adjacent the back-up cylinder for transmitting coating material directly from the fountain roller to the sheet thereby bypassing the form cylinder, extending the capability to use with coating materials of a viscous nature. Also in a preferred embodiment the fountain roller is driven by means separate from the press drive thereby to control the rate of application.

5 Claims, 4 Drawing Figures fig.1.
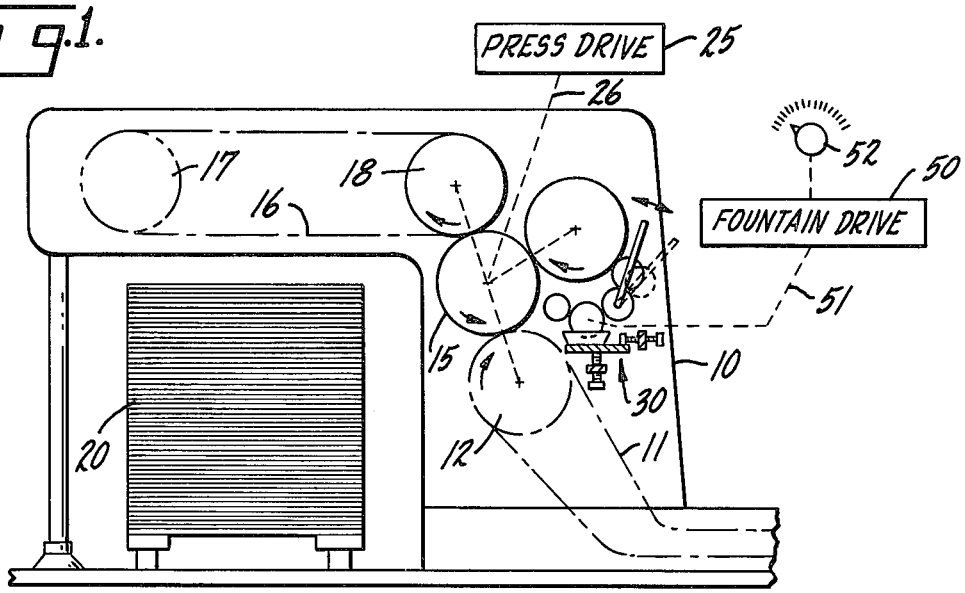
fig.1a.
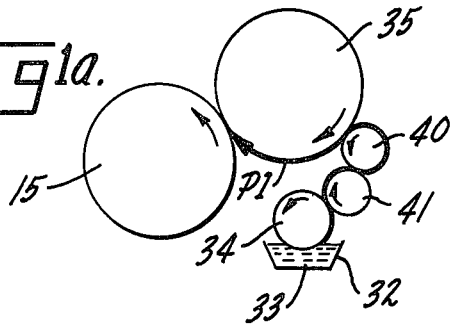
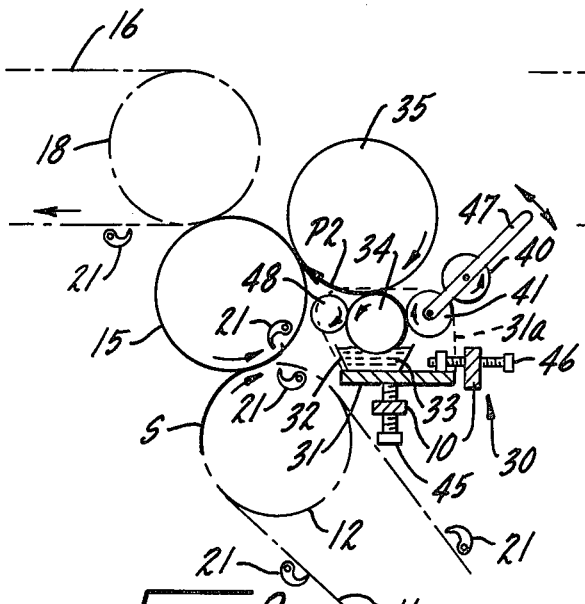
fig.2.
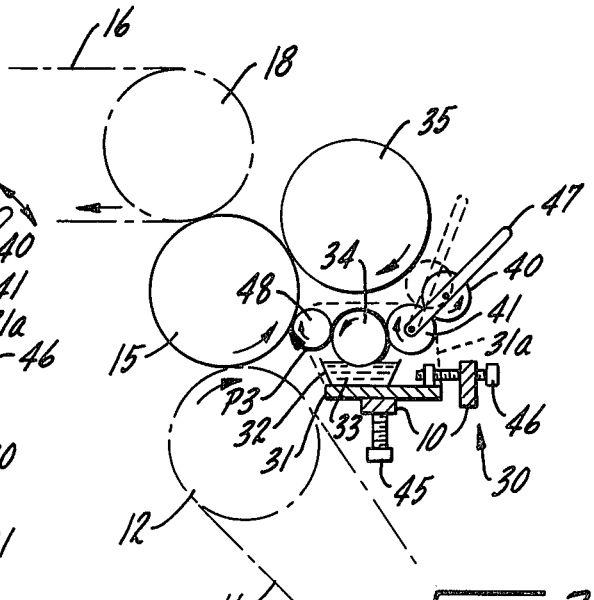
fig.3.

MECHANISM FOR APPLYING LACQUERS AND THE LIKE ON A PRINTING PRESS

In a sheet fed printing press, particularly of the lithographic type, it is frequently desired to coat a sheet with a liquid coating material, such as a lacquer, after the sheet has been printed and just prior to depositing the sheet on a delivery pile. It is, of course, desirable that the coating material be evenly distributed and applied while it is still in liquid form, before it dries on the rolls. Conventional coating assemblies have been capable of applying relatively slow drying materials, but when employed with fast drying materials the operation has not been successful since the material tends to dry before reaching the sheet. Nor are conventional coaters capable of handling coating materials having a wide range of drying time or wide range of viscosity.

It is, accordingly, an object of the present invention to provide a coating arrangement for use in connection with a lithograph printing press which overcomes the disadvantages of prior coaters and which is highly flexible, being capable of coating with a wide variety of materials having different drying times and different viscosities but which is, nonetheless, simple and economical in construction.

Other objects and advantages of the invention will become apparent upon reading the attached detailed description and upon reference to the drawings in which:

FIG. 1 shows the delivery end of a lithographic printing press including a coating mechanism in accordance with the present invention;

FIG. 1*a* is a fragmentary diagram showing the fluid path in FIG. 1;

FIG. 2 is a diagram showing the arrangement of FIG. 1 in an alternate mode.

FIG. 3 is a similar diagram showing a still further operating mode.

While the invention has been described in connection with a preferred embodiment, it will be understood that we do not intend to be limited to the embodiment shown but intend, on the contrary, to cover the various alternative and equivalent constructions included within the spirit and scope of the appended claims.

Turning now to FIG. 1 there is shown the delivery end of a printing press having a frame 10 and to which sheets are individually delivered upon a chain type conveyor 11 in which the chains are trained about a pulley 12. From the conveyor 11 sheets are individually passed to a back-up cylinder 15 and thence to a final chain type conveyor 16 having pulleys 17, 18. From the conveyor 16 sheets are deposited in a pile 20. The conveyor 11, cylinder 15 and conveyor 16 have, for simplicity, been shown in diagrammatic form. It will be understood that each of these includes grippers, generally indicated at 21 (FIG. 2) for engaging the leading edge of a printed sheet together with means for synchronously operating the grippers to effect transfer of the sheet from conveyor 11 to cylinder 15, and from cylinder 15 to conveyor 16, from which the sheet is dropped onto the pile. Also for the sake of simplicity the press drive 25 and drive train 26 have been shown diagrammatically, with the understanding that both driving and sheet transfer, from conveyor to cylinder and vice versa, are well understood to those skilled in the art, cross reference being made to the patent literature for the details of construction.

For the purpose of coating a sheet (a typical sheet being indicated at S in FIG. 2) as it is transported on the back-up cylinder 15, a fountain assembly 30 is provided including a subframe 31. Mounted on the subframe is a fountain 32 having a body of liquid coating material 33. Journaled in the subframe, for example, in side plates outlined at 31*a*, and with its lower surface projecting into the body of coating material, is a fountain roller 34 (see especially FIG. 2). For receiving a film of the coating material from the fountain roller and for transmitting it to a sheet conveyed by the back-up cylinder 15, a form cylinder is provided. Such form cylinder, indicated at 35, is journaled in the press frame 10 and synchronously driven via the drive train 26.

In accordance with the present invention the fountain roller 34 is equipped with a dosing roller and form roller which is engageable with the form cylinder to provide an alternate and longer path of liquid application. Thus we provide, in a position adjacent the form cylinder 35, a form roller 40. Interposed between the form roller 40 and the fountain roller 34, to provide communication between them, is a dosing roller 41. The form roller 40 and dosing roller 41 are both journaled for rotation in the subframe 31 and the subframe is so mounted and constructed, for shifting movement, that the fountain roller 34 and form roller 40 may be selectively engaged with the form cylinder 35. To permit movement of the subframe 31 it is floatingly mounted with respect to the main frame 10, with its position being determined by adjustable shifting means. In the illustrated embodiment shifting of the subframe 31 in the vertical direction is accomplished by an adjusting screw 45 while shifting in the horizontal direction is brought about by an adjusting screw 46, both adjusting screws being threadedly related to the main frame 10. It will be apparent that by unscrewing the adjusting screw 45 the level of the subframe 31 may be dropped to disengage the fountain roller 34 from the surface of the form cylinder 35.

In carrying out the present invention the shifting means preferably includes means for shifting the form roller 40 toward and away from the surface of the form cylinder 35, that is, in the direction of the arrows shown in FIG. 1. To this end the subframe includes a pair of arms 47 (only one of which is shown) which may be pivoted about the axis of the dosing roller 41 and with suitable means (not shown) for holding the arms in a desired operating position.

By manipulation of the shifting means, alternate paths are provided for the costing liquid proportioned in accordance with drying time. Thus referring to FIGS. 1 and 1*a*, the form roller 40 is advanced into liquid transmitting contact with the surface of the form cylinder 35, while the fountain roller 34 is retracted therefrom, to produce a liquid transference path P1. Such path is lengthy and suited to coating liquids having a relatively long drying time. Indeed, the path is sufficiently long so that volatile elements in the coating material are permitted to escape during the time that the coating material is formed into a smooth film by the action of the rollers 34, 41, 40 and cylinder 35, against one another. Thus when the coating material is transferred onto the sheet at the end of the path P1 it is still in liquid form but it is nonetheless preconditioned for drying after it is deposited upon the surface of the sheet so that the sheets do not stick together upon being deposited on the pile 20.

Alternatively, the supporting arms 47 (FIG. 2) may be swung away from the form cylinder 35 to retract the form roller 40 from contact, and the adjusting screw 45 may be screwed in to raise the subframe 31 to engage the fountain roller 34 with the surface of the form cylinder thereby to create a short transference path indicated at P2. The path is sufficiently short so that the coating liquid from the fountain is almost immediately applied to the sheet on the back-up cylinder without opportunity for drying to take place on the form cylinder. The mode illustrated in FIG. 2 is, therefore, ideally suited for use with coating liquids having a short drying time.

It will be noted that the rollers, and cylinder 35, are compatible in both of the modes of operation. Assuming that the form cylinder 35 is resiliently surfaced, the form roller 34 may be hard surfaced and in slightly indenting relation to insure that a smooth film is transferred along the path P2. Further, the dosing roller 41 is resiliently surfaced, and the form roller 40, unlike most conventional form rollers, is hard surfaced, indenting both the dosing roller and form cylinder so that a similar film, in even thickness, is transferred along the path P1. Moreover, it will be noted that the directions of the rollers are, in both modes, completely compatible, with the dosing roller 41 not only preserving the "hard-soft" order of the rollers but causing movement of the form roller surfaace 40 to be in the same direction as the surface of fountain roller 34 as required for alternate engagement. Thus it is a feature of the invention that the direction of the fountain roller is preserved in all operating modes.

In accordance with the preferred embodiment of the present invention an auxiliary, or second, form roller 48 is provided mounted on the subframe 31, interposed between the fountain roller and the back-up cylinder, and selectively engageable with the surface of the latter, so that the coating material from the fountain may be applied directly to the sheet on the back-up cylinder, thus bypassing the surface of the form cylinder 35. Such mode of operation, illustrated in FIG. 3, is especially suited for use with coating materials of a viscous nature, for example, certain viscous varnishes. To achieve the mode of operation shown in FIG. 3 the adjusting screw 45 and arms 47 are retracted, and adjusting screw 46 is advanced to shift the fountain subframe 31 horizontally to bring roller 48 against the surface of the back-up cylinder 15. This provides a transference path P3 which may, depending upon the diameter of the roller 48, be somewhat shorter than the path P2 previously mentioned.

It may be noted that while the assembly of rollers and cylinders discussed above provides three distinct, alternative modes of operation, all of the components in the system are, nevertheless, at all times active. Thus in the mode illustrated in FIG. 1, in which transference occurs via rollers 41, 40, the roller 48, by its continued rotation, performs a smoothing function, and this is also true of the mode shown in FIG. 2. Similarly, while rollers 40 and 41 are inactive in the modes of FIGS. 2 and 3 as far as liquid transference is concerned, such rollers, by their continuous rotation, continue to provide a smoothing function, insuring that the film which is transferred along paths P2, P3 is of an even and consistent nature. Thus the coating means, in addition to accommodating different drying times and different viscosities, is eminently usable with liquids that are difficult to spread, in an even film, in coating devices of more conventional design.

In the above discussion it has been assumed that the fountain roller and associated rollers are rotated either as the result of surface friction or by providing a suitable and synchronized drive connection with drive train 26. However, it is one of the features of the present invention that the fountain roller 34 is provided with separate driving means diagrammatically indicated at 50 in FIG. 1 and which includes a fountain drive train 51 with the speed of the drive being capable of separate manual adjustment by means of an adjusting knob 52, reference being made to the art relating to controlled speed drives for the details of construction. By separate control of the speed of rotation of the fountain roller 34, the rate at which the coating liquid is drawn from the fountain and hence the thickness of application to the sheet is under the precise control of the operator, with the difference in surface speed being accommodated by slippage, for example, by slippage at the surface of the fountain roller.

In the exemplary embodiment it will be noted that two separate means have been discloosed for achieving movement of the rollers. Thus the rollers may be mounted for bodily shifting movement with a subframe, such as subframe 31, as in the case of roller 34, or the rollers may be mounted for individual shifting, or swinging movement, as in the case of the roll 40 which is swingable on arms 47. If desired, the second form roller 48 may be swingably mounted in the same way as roller 40 for individual movement into and out of engagement with the back-up cylinder. Also if desired the form roller 34 may be individually mounted for movement vertically from the directly transferring position shown in FIG. 2 downwardly, accompanied by deeper submergence into the fountain, into the position shown in FIG. 3. The term "means for shifting the subframe" as used herein therefore includes the relative shifting of rollers with respect to the subframe. Selection of length of path "in accordance with drying speed" shall mean that a long path corresponds to a relatively slow drying speed and vice-versa.

While adjusting screws have been shown simply to illustrate the principle of operation, one skilled in the art will appreciate that in practice throw-over cams or eccentrics may be substituted to simplify shifting between precise alternate positions. The term fountain includes generally means for furnishing liquid to a fountain roller.

What is claimed is:

1. For use with a sheet-fed printing press, means for applying a liquid coating material to a sheet following the printing thereof which comprises a main frame, a back-up cylinder journaled in the main frame, means including grippers for transferring a sheet to the back-up cylinder for transport thereon and for removing the sheet therefrom for delivery, a form cylinder journaled in the main frame in rolling engagement with the back-up cylinder, means for driving the cylinders and gripper means in unison, a fountain assembly including a fountain for the coating material, a fountain roller rotating therein adjacent the form cylinder, a first form roller adjacent the form cylinder, a dosing roller communicatingly interposed between the fountain roller and the first form roller, and a second form roller interposed between the fountain roller and the back-up cylinder, and means for selectively shifting the fountain roller and form rollers with respect to the main frame to (a)

bring the fountain roller into exclusive liquid transmitting contact with the form cylinder, to (b) bring the first form roller into exclusive liquid transmitting contact with the form cylinder and to (c) bring the second form roller into exclusive liquid transmitting contact with the back-up cylinder thereby to change the length of the liquid transference path from the fountain to the sheet in accordance with the drying speed of the coating material and to insure evenly distributed liquid application of the coating material to the sheet.

2. For use with a sheet-fed printing press, means for applying a liquid coating material to a sheet following the printing thereof which comprises a main frame, a back-up cylinder journaled in the main frame, means including grippers for transferring a sheet to the back-up cylinder for transport thereon and for removing a sheet therefrom for delivery, a form cylinder journaled in the main frame in rolling engagement with the back-up cylinder, means for driving the cylinders and gripper means in unison, a fountain assembly having a sub-frame mounted on the main frame and shiftable with respect to it, the fountain assembly including a fountain for the coating material, a fountain roller rotating therein adjacent the form cylinder, a form roller adjacent the form cylinder, a dosing roller communicatingly interposed between the fountain roller and the form roller, and means for selectively shifting the sub-frame with respect to the main frame into alternative conditions to (a) bring the fountain roller into exclusive liquid transmitting contact with the form cylinder and to (b) bring the form roller into exclusive liquid transmitting contact with the form cylinder thereby to change the length of the liquid transference path from the fountain to the sheet in accordance with the drying speed of the coating material to insure evenly distributed liquid application of the coating material to the sheet.

3. The combination as claimed in claim 2 in which a separate drive independent of the press drive is provided for the fountain roller.

4. The combination as claimed in claim 3 in which the drive is provided with speed adjusting means permitting a surface speed lower than press speed for controlling the rate at which the liquid coating material is fed from the fountain.

5. For use with a sheet-fed printing press, means for applying a liquid coating material to a sheet following the printing thereof which comprises a main frame, a back-up cylinder journaled in the main frame, means including grippers for transferring a sheet to the back-up cylinder for transport thereon and for removing the sheet therefrom for delivery, a form cylinder journaled in the main frame in rolling engagement with the back-up cylinder, means for driving the cylinders and gripper means in unison, a fountain assembly including a fountain for the coating material, a fountain roller rotating therein adjacent the form cylinder, a first form roller adjacent the form cylinder, a dosing roller communicatingly interposed between the fountain roller and the first form roller, and a secoond form roller interposed between the fountain roller and the back-up cylinder, and means for selectively shifting the fountain roller and form rollers with respect to the main frame to (a) bring the fountain roller into exclusive liquid transmitting contact with the form cylinder, to (b) bring the first form roller into exclusive liquid transmitting contact with the form cylinder and to (c) bring the second form roller into exclusive liquid transmitting contact with the back-up cylinder thereby to change the length of the liquid transference path from the fountain to the sheet in accordance with the drying speed of the coating material and to insure evenly distributed liquid application of the coating material to the sheet, the rollers being surfaced to produce an alternating hard-soft liquid transfer sequence and the cylinders being driven without reversal of direction during all three exclusive liquid transmitting modes.

* * * * *